US011084293B2

(12) United States Patent
Rourke et al.

(10) Patent No.: US 11,084,293 B2
(45) Date of Patent: Aug. 10, 2021

(54) CONTAINER FOR FLUID

(71) Applicant: HEWLETT-PACKARD DEVELOPMENT COMPANY, L.P., Spring, TX (US)

(72) Inventors: Kevin Rourke, Leixlip (IE); Kelvin Chiew, Singapore (SG); Tong Nam Samuel Low, Singapore (SG); Erick Blane Kinas, Vancouver, WA (US); James Mannion, County Kildare (IE); Joe Ronaldson, County Kildare (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,023

(22) PCT Filed: Oct. 18, 2017

(86) PCT No.: PCT/US2017/057160
§ 371 (c)(1),
(2) Date: Oct. 14, 2019

(87) PCT Pub. No.: WO2019/078843
PCT Pub. Date: Apr. 25, 2019

(65) Prior Publication Data
US 2021/0129545 A1 May 6, 2021

(51) Int. Cl.
*B41J 2/175* (2006.01)

(52) U.S. Cl.
CPC ..... *B41J 2/17526* (2013.01); *B41J 2/17566* (2013.01)

(58) Field of Classification Search
CPC ..... B41J 2/17526; B41J 2/17566
See application file for complete search history.

(56) References Cited

U.S. PATENT DOCUMENTS

| | | | | |
|---|---|---|---|---|
| 5,465,619 | A | 11/1995 | Sotack | |
| 6,415,111 | B1 | 7/2002 | Higeta | |
| 7,562,557 | B2 | 7/2009 | France | |
| 7,568,389 | B2 | 8/2009 | Eguchi et al. | |
| 9,701,129 | B2 | 7/2017 | Pourtier et al. | |
| 2008/0069576 | A1 | 3/2008 | Etter et al. | |
| 2016/0263905 | A1* | 9/2016 | Kimura | B41J 2/17509 |
| 2016/0271941 | A1* | 9/2016 | Yokoyama | B41J 2/175 |

FOREIGN PATENT DOCUMENTS

| | | | |
|---|---|---|---|
| EP | 0047521 | B1 | 3/1982 |
| EP | 1007914 | A1 | 6/2000 |
| WO | WO2006084263 | A2 | 8/2006 |

OTHER PUBLICATIONS

Printer Ink Level Sensor/printer Ink Tank Float Switch for Large Format Printer, https://www.alibaba.com/product-detail/printer-ink-level-sensor-printer-ink_60230279759.html?spm=a2700.7724857.main07.448.2bd139753t1cV2.

* cited by examiner

*Primary Examiner* — Anh T Vo
(74) *Attorney, Agent, or Firm* — Fabian VanCott

(57) ABSTRACT

A print agent vessel is disclosed that comprises a circuit, the circuit comprising a first electrically conductive portion to couple to a first terminal of a printing device, a second electrically conductive portion to couple to a second terminal of the printing device, and an electrically conductive component capacitively coupled to the first electrically conductive portion. The circuit has a variable capacitance that is indicative of a parameter of the component.

15 Claims, 3 Drawing Sheets

CONTAINER FOR FLUID

BACKGROUND

Electrical circuits may be used to detect the presence or level of a liquid in a container. The electrical circuits may include components that measure the presence or level of liquid, and other parts such as connectors, wires and traces that enable electrical connection to the components.

BRIEF DESCRIPTION OF THE DRAWINGS

Non-limiting examples will now be described with reference to the accompanying drawings, in which.

DETAILED DESCRIPTION

In some examples, print agent vessel may comprise a circuit. The circuit may comprise a first electrically conductive portion to couple to a first terminal of a printing device, and a second electrically conductive portion to couple to a second terminal of the printing device. The circuit may also comprise an electrically conductive component capacitively coupled to the first electrically conductive portion. The circuit may have a variable capacitance that is indicative of a parameter of the component.

Figure 1:
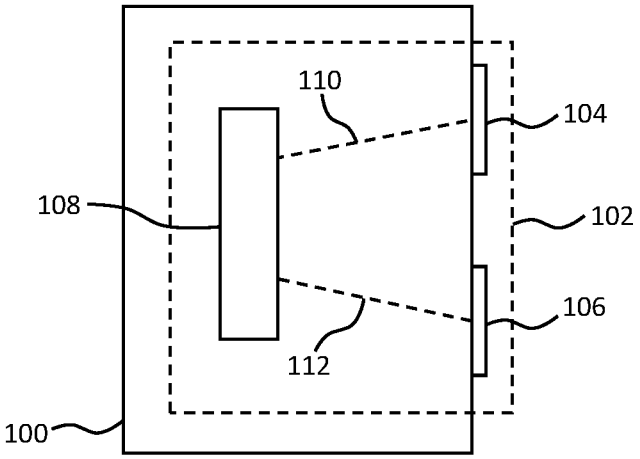
FIG. 1 is a schematic drawing of an example of a print agent vessel.

FIG. 1 is a schematic drawing of an example print agent vessel 100 that includes a circuit 102. The circuit 102 includes a first electrically conductive portion 104 and a second electrically conductive portion 106. The circuit 102 also includes an electrically conductive component 108 that is coupled to the first 104 and second 106 electrically conductive portions via couplings 110 and 112 respectively. The coupling 110 is a capacitive coupling. That is, there is at least one capacitance such as a capacitor between the electrically conductive portion and the first conductive portion 104. The capacitance may be fixed or variable. In some examples, the coupling 112 may also be a capacitive coupling.

The circuit 102 has a variable capacitance that is indicative of a parameter of the circuit 102. The variable capacitance may be the capacitance of the coupling 110, the capacitance of the coupling 112, or any other capacitance within the circuit 102. The parameter of the component 108 may be indicative of, for example, an amount of print agent in the vessel 100.

In some examples, the variable capacitance is indicative of the parameter of the circuit 102 by way of the manner in which the capacitance varies. For example, the capacitance may vary with a frequency and/or decay pattern that depends on the amount of print agent within the vessel 100. This may be achieved for example through vibration of the electrically conductive component 108, wherein a vibration characteristic such as frequency and/or decay may vary depending on whether the component is in contact with print agent within the vessel 100.

In some examples, the capacitance may vary in response to a stimulus applied to the vessel 100. For example, the stimulus may cause a part of the circuit, such as the electrically conductive component 108, to vibrate. In some examples, the stimulus may be an impulse, or sudden force, that is applied by causing the vessel to rapidly decelerate, for example by stopping a carriage housing the vessel 100 suddenly, or by causing the carriage to knock against a stopping member. The stimulus may be, for example, a step change in movement speed of the vessel 100. In some examples, an external device, such as an electromagnet, may be used to generate an impulse force by generating a magnetic field to act on the circuit (e.g. on the electrically conductive component 108), then remove the magnetic field.

Another way of applying the stimulus may be to cause movement of the vessel in a cyclic or oscillatory manner at a defined frequency. In some examples, a direction of movement of the vessel 100 may rapidly and repeatedly be reversed. For example, a mechanism for causing a carriage housing the vessel 100 to move within a printing apparatus may cause the vessel 100 to move backwards and forwards, for example along a track, at the defined frequency. Fluid, such as print agent, within the vessel 100 may be caused to slosh from one side of the fluid container to an opposite side of the fluid container at the same defined frequency. The moving liquid may contact a part of the circuit 102 (e.g. the electrically conductive component 108). The capacitance of the circuit may then vary at a rate corresponding to the driving frequency, and the change in capacitance may be measured, for example by circuitry connected to the circuit 102. Thus, a frequency representation of the capacitance may include a component at the driving frequency. This may also be the case in some examples where the level of liquid is below the level at which it would contact the part of the circuit (e.g. the component 108), as movement of the vessel may also cause movement of the part of the circuit and hence a variation in capacitance at the driving frequency. In some examples, the capacitance response to a cyclic or oscillatory movement of the vessel may be indicative of whether the circuit 102 or part of the circuit (e.g. component 108) is present and/or operating correctly.

Figure 2:
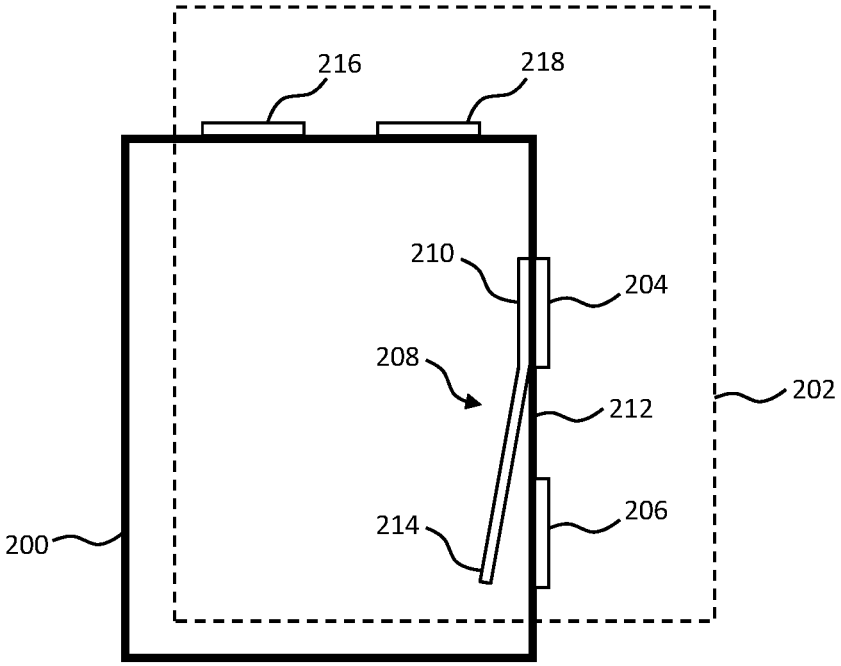
FIG. 2 is a schematic drawing of an example of a print agent vessel.

FIG. 2 a schematic drawing of an example print agent vessel 200 that includes a circuit 202. The circuit 202 includes a first electrically conductive portion 204 and a second electrically conductive portion 206. The circuit 202 also includes an electrically conductive component 208 that is capacitively coupled to the first 204 and second 206 electrically conductive portions.

The electrically conductive component 208 comprises a first portion 210 that is fixed to the vessel 200, such as for example to a wall 212 of the vessel 200. The component 210 also includes a free portion 214 that is connected to the fixed portion 210 but is free to vibrate within the vessel 200. To facilitate this, the component 208 may include a flexible portion. In some examples, the component is a monolithic component comprised of a flexible material such as an electrically conductive material, for example metal.

The fixed portion 210 of the electrically conductive component 208 is capacitively coupled to the first electrically conductive portion 204 through the wall 212 of the print agent vessel 200. That is, for example, the fixed portion 210 and the first electrically conductive portion 204 comprise plates of a capacitor. The capacitance of this capacitor is fixed in this example.

The free portion 214 of the electrically conductive component 208 is also capacitively coupled to the second electrically conductive portion 206 through the wall 212 of the print agent vessel 200. Therefore, for example, the free portion 214 and the second electrically conductive portion 206 form the plates of an additional capacitor. As the free portion 214 of the component 208 is free to vibrate, the capacitance of the additional capacitor is variable. Furthermore, as the component 208 is electrically conductive, the capacitor formed from the fixed portion 210 and the first electrically conductive portion 204 and the capacitor formed from the free portion 214 and the second electrically conductive portion 206 are electrically arranged in series. In some examples, a stimulus such as the examples described above may be applied to the vessel 200, causing the capacitance of the circuit 202 (and in particular the capacitance between electrically conductive portion 206 and the free portion 214) to vary in a manner that is indicative of a parameter of the component.

In some examples, a vibration characteristic of the component 208 is indicative of a parameter of the circuit 202, such as for example whether the free portion 214 of the component 208 is immersed in print agent within the vessel 200. In some examples, vibration of the component 208 may be induced, for example through movement of the vessel 200 or through magnetic attraction or repulsion of the component 208, and the capacitance of the circuit 202 monitored over time to monitor a vibration characteristic of the component 208.

The circuit 202 also includes terminals 216 and 218 electrically connected to the first 204 and second 206 electrically conductive portions respectively. The terminals 216 and 218 are to permit communication between the circuit 202 and another apparatus, such as for example a printing apparatus in which the print agent vessel 200 is installed. Therefore, the printing apparatus may communicate with the circuit 202, such as for example by measuring the capacitance of the circuit 202 in any suitable manner. Electrical connection between the terminals 216 and 218 and the printing apparatus may be achieved for example through direct contact connections using pins or the like, or through additional capacitive connections.

The terminal 216 may be connected to the first electrically conductive portion 204 through wires, traces and/or any other suitable electrical components (not shown). Similarly, the terminal 218 may be connected to the second electrically conductive portion 206 through wires, traces and/or any other suitable electrical components (not shown). In some examples, the electrically conductive portions 204 and 206, terminals 216 and 218 and any electrical connections therebetween may be formed on a medium such as an adhesive label that is fixed to an outside surface of the vessel 200.

In the example print agent vessel 200, the component 208 may be disposed within the interior of the vessel 200, such that for example the component 208 may contact print agent if the print agent is above a certain amount and the vessel 200 is in an intended orientation (for example, installed in a printing apparatus that is on a stable, flat surface). The capacitive connections with the first and second electrically conductive portions 204 and 206 may be formed through the wall 212 of the vessel 200 without any components penetrating the wall 212. In other examples, the capacitive connections may be made through different walls of the vessel 200.

In some examples, the component 208 (e.g. the free portion 214) may have a resonant vibrational frequency in the order of 10 to 100 Hz. This is within the range of frequencies that may be readily achieved using, for example, a component 208 in the form of a stainless steel flat spring with dimensions suitable for inclusion in a vessel 200 such as a replaceable print agent vessel, and detection apparatus (for example, analogue to digital converters, capacitance measurement apparatus and/or other detection apparatus) that is sensitive to this range is readily available. In addition, it may be noted that a component 208 with a higher resonant frequency may have lower displacement for the same quantity of input energy and therefore the movement of the free portion 214 (e.g. through measurement of capacitance of the circuit 202) may become more difficult to detect with increasing resonant frequency. Moreover, higher frequencies are associated with higher sampling rates in order to accurately characterise the oscillation. Higher sampling rates may in turn consume greater monitoring and processing resource.

The lower end of the frequency range may be associated with the size of the component 208 (which may in turn be limited by the size of the vessel 200). Thus, with different processing and/or size constraints, different frequency ranges may be appropriate.

In some examples, frequencies around national power supply frequencies (for example, around 50 Hz and 60 Hz in most countries) may be avoided, as this can result in a false reading due to the power supply signal contaminating a series of measurements taken from the circuit 202 over a period of time.

Figure 3:
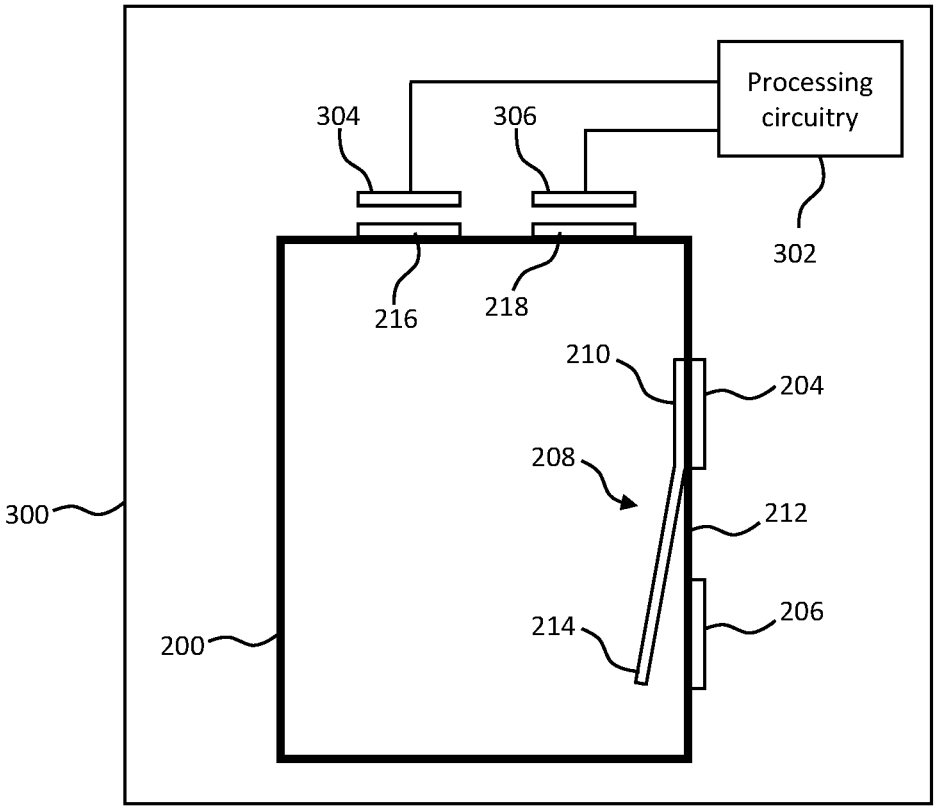
FIG. 3 is a schematic drawing of an example printing apparatus.

FIG. 3 is a schematic drawing of an example printing apparatus 300 in which a print agent vessel, such as for example the print agent vessel 200, is installed. The printing apparatus includes processing circuitry 302 which includes terminals 304 and 306. In the example shown, the printing apparatus 300 is capacitively coupled to the print agent vessel 200. That is, the terminals 304 and 216 form a first capacitor across an air gap there between, and the terminals 306 and 218 form a second capacitor across an air gap there between. As such, there is no direct electrical connection between the processing circuitry 302 and the component 208. Instead, the processing circuitry 302 is connected to a plurality of series capacitances, one of which is variable and is indicative of a parameter of the print agent vessel 200 (e.g. an amount of print agent in the vessel 200). The processing circuitry 302 may detect the variation in the series capacitances to derive an indication of the parameter.

Figure 4:
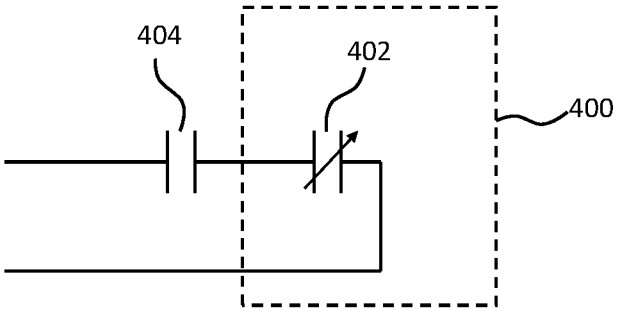
FIG. 4 is a schematic drawing of an example of a container for fluid.

FIG. 4 is a schematic drawing of an example container 400 for fluid. The container comprises a device having a first capacitance 402 that is variable responsive to a property of the device, such as for example a level or an amount of fluid within the container 400, for example following a stimulus such as the examples described above. The first capacitance 402 is measurable through a second capacitance 404 in series with the first capacitance 402. For example, the first capacitance 402 includes a capacitor comprising a first electrode on a first side of a wall of the container 400 and a second electrode on a second side of the wall of the container 400 opposite the first side. In some examples, the second capacitance 404 includes a capacitor comprising a first electrode on a first side of a wall of the container and a second electrode on a second side of the wall of the container opposite the first side. One of the first and second capacitances 402 and 404 may then be variable responsive to the property of the device. As such, either the first capacitance 402 and/or the second capacitance 404 comprises a contactless connection through the wall of the container.

In some examples, the second capacitance 404 includes a capacitor comprising a first electrode on the container and a second electrode on a printing apparatus. Therefore, there may be at least one contactless connection between the container 400 and the printing apparatus.

In some examples, the second capacitance is variable responsive to an additional property of the device. For example, where the first capacitance is variable due to vibration or other movement of one plate of a first capacitor having the first capacitance, the second capacitance may also be variable due to vibration or other movement of one plate of a second capacitor having the second capacitance.

In some examples, where the second capacitance 404 includes a capacitor comprising a first electrode on the container 400 and a second electrode on a printing apparatus, the container 400 may also include a third capacitance including a capacitor comprising a third electrode on the container 400 and a fourth electrode on the printing apparatus. As such, both electrodes on the container 400 may be capacitively connected to respective electrodes on the printing apparatus, such that there is no direct contact electrical connection between the container 400 and the printing apparatus.

Figure 5:
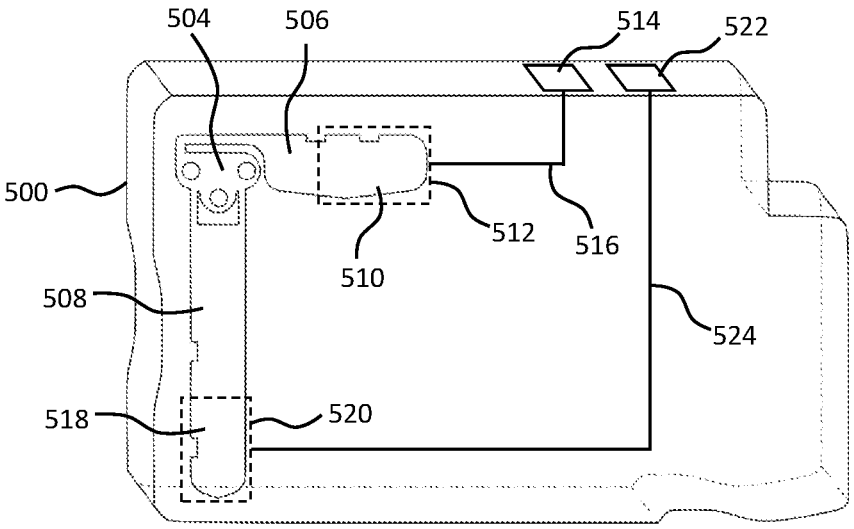
FIG. 5 is a schematic drawing of an example of a container for fluid.

FIG. 5 is a schematic drawing of an example container 500 for fluid. The container 500 includes an electrically conductive component 502 that is mounted to an interior of the container 500 at a mount point 504. The component 502 includes a first flexible arm 506 and a second flexible arm 508 that are free to move or vibrate about the mount point 504. A portion 510 of the first arm 506 forms one plate of a first capacitor, the other plate of the first capacitor being formed by an electrically conductive portion 512 that is fixed relative to the container 500 and is spaced apart from the portion 510 of the first arm 506. For example, the electrically conductive portion 512 is fixed to a wall of the container 500 or is mounted on a medium fixed to the container 500 such as an adhesive label. The electrically conductive portion 512 is connected to a first terminal 514 via a first trace 516.

Similarly, a portion 518 of the second arm 508 forms one plate of a second capacitor, the other plate of the second capacitor being formed by an electrically conductive portion 520 that is fixed relative to the container 500 and is spaced apart from the portion 518 of the second arm 508. For example, the electrically conductive portion 520 is fixed to a wall of the container 500 or is mounted on a medium fixed to the container 500 such as an adhesive label. The electrically conductive portion 520 is connected to a second terminal 522 via a first trace 524. The arms 506 and 508 may be mounted in an interior of the container 500, for example on one side of a wall of the container 500, and the electrically conductive portions 512 and 520 may in some examples be mounted outside of the interior, such as on an opposite side of the wall of the container. The electrically conductive portions 512 and 520 are shown as dashed outlines for clarity.

In some examples, the electrically conductive portions 512 and 520, the terminals 514 and 522 and the traces 516 and 524 are formed on a medium, such as for example an adhesive label, which is then fixed to an outside surface of the container 500.

The container 500 therefore includes two variable capacitors connected in series between the terminals 514 and 522, each variable capacitor being responsive to a property of the device, such as for example a level or an amount of fluid within the container 400, for example in response to a stimulus such as the examples described above. In the orientation shown in FIG. 5, as for example a level of print agent within the container 500 drops, the first arm 506 of the component 502 will be exposed (i.e. no longer contact the print agent) before the second arm 508, and therefore a movement characteristic, such as for example a vibration frequency and/or decay, may indicate the level of print agent in the container 500. Monitoring the capacitance between the terminals 514 and 522 may obtain an indication of the parameter of the container 500. In some examples, the resonant frequency of the first arm 506 may be different to the resonant frequency of the second arm 508, and so frequency analysis of the variation in capacitance over time between the terminals 514 and 522 may indicate which of the arms 506 and 508 is vibrating and their decay rates, and hence a level of print agent within the container may be determined. For example, a capacitance associated with the first arm 506 may indicate a first parameter, such as whether print agent has fallen below a first level, and a capacitance associated with the second arm 508 may indicate a second parameter such as whether print agent has fallen below a second level.

Figure 6:
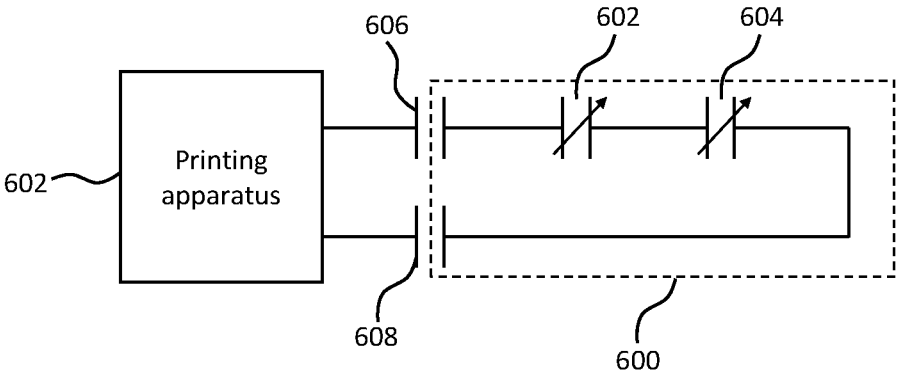
FIG. 6 is a schematic drawing of an example of a container for fluid.

FIG. 6 is a schematic drawing of an example container 600 for fluid when connected to printing apparatus 602 using contactless, capacitive connections. The container 600 includes two series connected variable capacitances 602 and 604 indicative of respective parameters of the container 600, such as for example whether a fluid level within the container 600 has fallen below respective levels, for example in response to a stimulus applied to the container 600. The capacitances are connected in series with and between fixed capacitors 606 and 608 which represent the capacitances of the contactless connections between the container 600 and the printing apparatus 602. Similar to as described hereinbefore, monitoring the capacitance of the series capacitances 602, 604, 606 and 608 may be indicative of one or more parameters of the container 600. The container 600 and printing apparatus 602 shown in FIG. 6 may in some examples include further components (not shown) including further electrical components.

In some examples described above, multiple capacitances are arranged in series. However, in some examples at least some of the capacitances may instead be arranged in parallel. For example, in some examples including two variable capacitances each corresponding to respective components or parts of a component such as a flexible arm, the variable capacitances may be arranged in an electrically parallel configuration.

Some examples described above include one or two variable capacitances within a replaceable print component or a print agent container or vessel for fluid. In other examples, there may be more variable capacitances, each of which can be indicative of for example whether an amount of fluid or print agent is above or below a respective level. For example, variation of each of the capacitances to include a frequency component at a respective frequency or within a respective frequency range may indicate whether the fluid or print agent amount is above or below the respective level.

While the apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent vessel comprising:

a circuit, the circuit comprising:

a first electrically conductive portion to couple to a first terminal of a printing device;

a second electrically conductive portion to couple to a second terminal of the printing device; and an electrically conductive component capacitively coupled to the first electrically conductive portion, wherein the circuit has a variable capacitance that is indicative of a parameter of the component.

2. The print agent vessel of claim 1, wherein the electrically conductive component is capacitively coupled to the first electrically conductive portion through a wall of the print agent vessel.

3. The print agent vessel of claim 2, wherein the electrically conductive component is capacitively coupled to second electrically conductive portion through a wall of the print agent vessel.

4. The print agent vessel of claim 1, wherein a capacitance between the electrically conductive component and the first electrically conductive portion is variable to indicate the parameter of the component.

5. The print agent vessel of claim 4, wherein a capacitance between the electrically conductive component and the second electrically conductive portion is variable to indicate a further parameter of the component.

6. The print agent vessel of claim 1, wherein the parameter of the electrically conductive component comprises an amount of print agent within the print agent vessel.

7. A container for fluid, the container comprising:

a device having a first capacitance that is variable responsive to a property of the device;

wherein the first capacitance is measurable through a second capacitance in series with the first capacitance.

8. The container of claim 7, wherein the first capacitance includes a capacitor comprising a first electrode on a first side of a wall of the container and a second electrode on a second side of the wall of the container opposite the first side.

9. The container of claim 7, wherein the second capacitance includes a capacitor comprising a first electrode on a first side of a wall of the container and a second electrode on a second side of the wall of the container opposite the first side.

10. The container of claim 7, wherein the second capacitance includes a capacitor comprising a first electrode on the container and a second electrode on a printing apparatus.

11. The container of claim 7, wherein the second capacitance is variable responsive to an additional property of the device.

12. The container of claim 11, further comprising a third capacitance including a capacitor comprising a third electrode on the container and a fourth electrode on the printing apparatus.

13. The container of claim 7, wherein the property of the device is whether fluid within the container is in contact with the device.

14. A print agent container comprising:

a first electrically conductive portion to capacitively couple to a first electrode of a printing device;

a second electrically conductive portion to capacitively couple to a second electrode of the printing device; and a circuit electrically connected between the first and second electrically conductive portions and having a capacitance that is indicative of a parameter of a component of the circuit.

15. The print agent container of claim 14, further comprising a fixed capacitor in series with the capacitance, the fixed capacitor comprising electrodes on either side of a wall of the container.

* * * * *